US009138990B2

(12) United States Patent
Benjamin et al.

(10) Patent No.: US 9,138,990 B2
(45) Date of Patent: Sep. 22, 2015

(54) FLUID EJECTION DEVICE

(75) Inventors: Trudy Benjamin, Portland, OR (US); Joseph M. Torgerson, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 738 days.

(21) Appl. No.: 13/131,069

(22) PCT Filed: Dec. 8, 2008

(86) PCT No.: PCT/US2008/085883

§ 371 (c)(1), (2), (4) Date: May 25, 2011

(87) PCT Pub. No.: WO2010/068192

PCT Pub. Date: Jun. 17, 2010

(65) Prior Publication Data

US 2011/0234669 A1 Sep. 29, 2011

(51) Int. Cl.
*B41J 29/38* (2006.01)
*B41J 2/045* (2006.01)

(52) U.S. Cl.
CPC ..... *B41J 2/04541* (2013.01); *B41J 2/0458* (2013.01); *B41J 2/04543* (2013.01); *Y10T 29/49401* (2015.01)

(58) Field of Classification Search
CPC ..... B41J 2/0455
USPC ..... 347/5, 9, 50, 57, 12, 65
See application file for complete search history.

(56) References Cited

U.S. PATENT DOCUMENTS

| | | | |
|---|---|---|---|
| 5,400,059 | A | 3/1995 | Kwon |
| 5,548,319 | A | 8/1996 | Kwon |
| 5,644,342 | A | 7/1997 | Argyres |
| 5,675,365 | A | 10/1997 | Becerra et al. |
| 6,176,569 | B1 | 1/2001 | Anderson et al. |
| 6,190,000 | B1 | 2/2001 | Krouss et al. |
| 6,293,658 | B1 | 9/2001 | Silverbrook |
| 6,318,828 | B1 | 11/2001 | Barbour et al. |
| 6,425,653 | B1 | 7/2002 | Bloomberg |

(Continued)

FOREIGN PATENT DOCUMENTS

| | | | |
|---|---|---|---|
| CN | 1972804 | A | 5/2007 |
| JP | 2731908 | B2 | 12/1989 |

(Continued)

OTHER PUBLICATIONS

Search Report for EP Application No. 08878796.5, dated Jan. 16, 2014, 7 pp.

*Primary Examiner* — Lam Nguyen
(74) *Attorney, Agent, or Firm* — Hewlett-Packard Patent Department

(57) ABSTRACT

A fluid ejection device includes a plurality of address lines and a fire line for communicating a fire signal. The device also includes a plurality of nozzle circuits coupled to the fire line and the plurality of address lines. Each nozzle circuit is configured, when enabled, to eject fluid via a different one of a plurality of nozzles in response to the fire signal. A subset of the plurality of address lines is coupled to each pair of the plurality of nozzle circuits. Each subset that is coupled to one of the pairs of nozzle circuits is selected so that simultaneous activation of every address line of that subset simultaneously enables each nozzle circuit in the pair or pairs of nozzle circuits coupled to that triad and none of the other nozzle circuits of the plurality of nozzle circuits.

17 Claims, 9 Drawing Sheets

(56) References Cited

U.S. PATENT DOCUMENTS

| | | | | |
|---|---|---|---|---|
| 6,439,697 | B1 | 8/2002 | Axtell et al. | |
| 6,478,396 | B1 | 11/2002 | Schloeman et al. | |
| 6,481,817 | B1 | 11/2002 | Torgerson et al. | |
| 6,540,333 | B2 | 4/2003 | Axtell et al. | |
| 6,543,882 | B2 | 4/2003 | Axtell et al. | |
| 6,659,581 | B2 | 12/2003 | Schloeman et al. | |
| 6,698,857 | B2 | 3/2004 | Torgerson et al. | |
| 6,726,300 | B2 | 4/2004 | Schloeman et al. | |
| 6,808,241 | B2 * | 10/2004 | Mackenzie et al. | 347/9 |
| 6,932,460 | B2 | 8/2005 | Axtell et al. | |
| 7,029,084 | B2 | 4/2006 | Schloeman et al. | |
| 7,036,914 | B1 | 5/2006 | Axtell et al. | |
| 7,073,883 | B2 | 7/2006 | Billow | |
| 7,073,896 | B2 | 7/2006 | Steiner et al. | |
| 7,090,338 | B2 | 8/2006 | Axtell et al. | |
| 7,104,624 | B2 | 9/2006 | Schloeman et al. | |
| 7,252,352 | B2 | 8/2007 | Ou et al. | |
| 7,367,655 | B2 | 5/2008 | Scardovi et al. | |
| 7,380,895 | B2 * | 6/2008 | Sugahara | 347/9 |
| 7,384,113 | B2 | 6/2008 | Benjamin et al. | |
| 7,431,432 | B2 | 10/2008 | Worsman et al. | |
| 2002/0171716 | A1 | 11/2002 | Jeanmaire | |
| 2004/0179065 | A1 | 9/2004 | MacKenzie et al. | |
| 2004/0183844 | A1 | 9/2004 | Anderson et al. | |
| 2004/0263547 | A1 | 12/2004 | Sugahara | |
| 2005/0230493 | A1 | 10/2005 | Benjamin et al. | |
| 2005/0231540 | A1 | 10/2005 | Benjamin et al. | |
| 2005/0231541 | A1 | 10/2005 | Benjamin et al. | |
| 2005/0231545 | A1 | 10/2005 | Benjamin et al. | |
| 2005/0231562 | A1 | 10/2005 | Torgerson et al. | |
| 2006/0055746 | A1 | 3/2006 | Weksler et al. | |
| 2006/0114277 | A1 | 6/2006 | Corrigan | |
| 2006/0125861 | A1 | 6/2006 | Silverbrook et al. | |
| 2006/0125876 | A1 | 6/2006 | Walmsley et al. | |
| 2006/0132521 | A1 | 6/2006 | Walmsley et al. | |
| 2006/0181558 | A1 | 8/2006 | Walmsley et al. | |
| 2006/0274112 | A1 | 12/2006 | Pulver et al. | |
| 2007/0019016 | A1 | 1/2007 | Silverbrook et al. | |
| 2007/0046711 | A1 | 3/2007 | Barkley | |
| 2007/0081029 | A1 | 4/2007 | Worsman | |
| 2007/0097178 | A1 | 5/2007 | Benjamin et al. | |
| 2007/0176976 | A1 * | 8/2007 | Fujiwara | 347/65 |
| 2008/0204493 | A1 | 8/2008 | Benjamin et al. | |

FOREIGN PATENT DOCUMENTS

| | | |
|---|---|---|
| JP | H01299050 A | 12/1989 |
| JP | 1991-227632 | 10/1991 |
| JP | 1997-039247 | 2/1997 |
| JP | 1997-048125 | 2/1997 |
| JP | 2003-291344 | 10/2003 |
| JP | 2004-268590 | 9/2004 |
| JP | 2005-035271 | 2/2005 |

* cited by examiner

FLUID EJECTION DEVICE

BACKGROUND

Fluid ejection devices such as printer ink cartridges include nozzle circuits formed on an integrated circuit. Those nozzle circuits are utilized to vaporize fluid held in chambers, selectively ejecting droplets of fluid through various nozzles. A given fluid ejection device can include a number of nozzle circuits and corresponding nozzles. Those nozzle circuits can be divided into groups in any of a number of manners. Each nozzle circuit in a particular grouping, sometimes referred to as a data line grouping, is coupled to a common fire line through which the nozzle circuits in the grouping simultaneously receive a fire signal. However, only the enabled nozzle circuits eject fluid through corresponding nozzles in response to the fire signal. Current implementations only allow one nozzle circuit in a data line grouping to be enabled at any given time. Such limitations prevent a pair of nozzle circuits in the data line grouping from simultaneously ejecting droplets through corresponding nozzles. Where the corresponding nozzles are positioned adjacent to one another, simultaneous ejection of droplets could prove beneficial as the resulting fluid droplets merge to form a larger droplet allowing for increased fluid flux and faster printing speeds.

DRAWINGS

Figure 1:
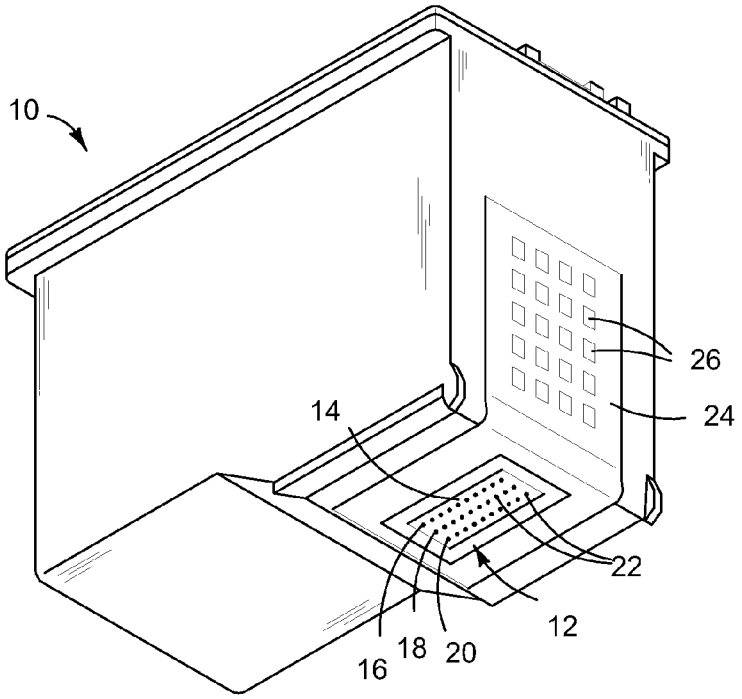
FIG. 1 is a perspective view illustrating the exterior of an ink cartridge.

FIGS. 3A-3D detail section view showing a portion of the print head in the cartridge of FIG. 1 in which fluid droplets are being ejected according various embodiments.

Figure 4:
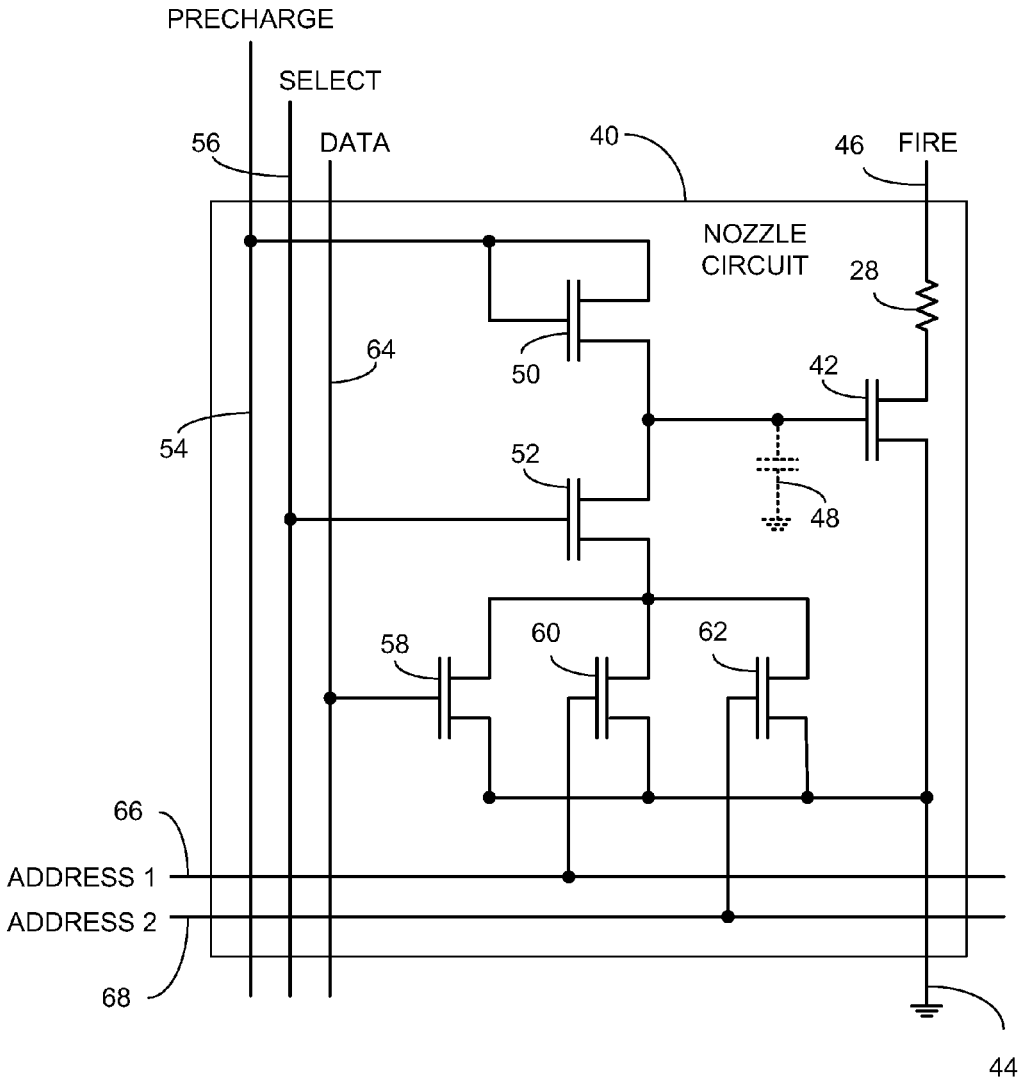

FIG. 4 is a circuit diagram of a nozzle circuit for a nozzle according to an embodiment.

Figure 5:
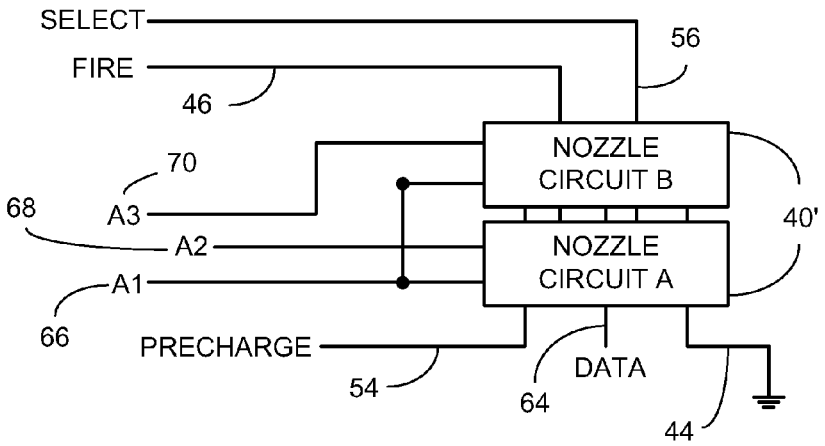

FIG. 5 is a block diagram of an addressable pair of nozzle circuit according to an embodiment.

Figure 6:
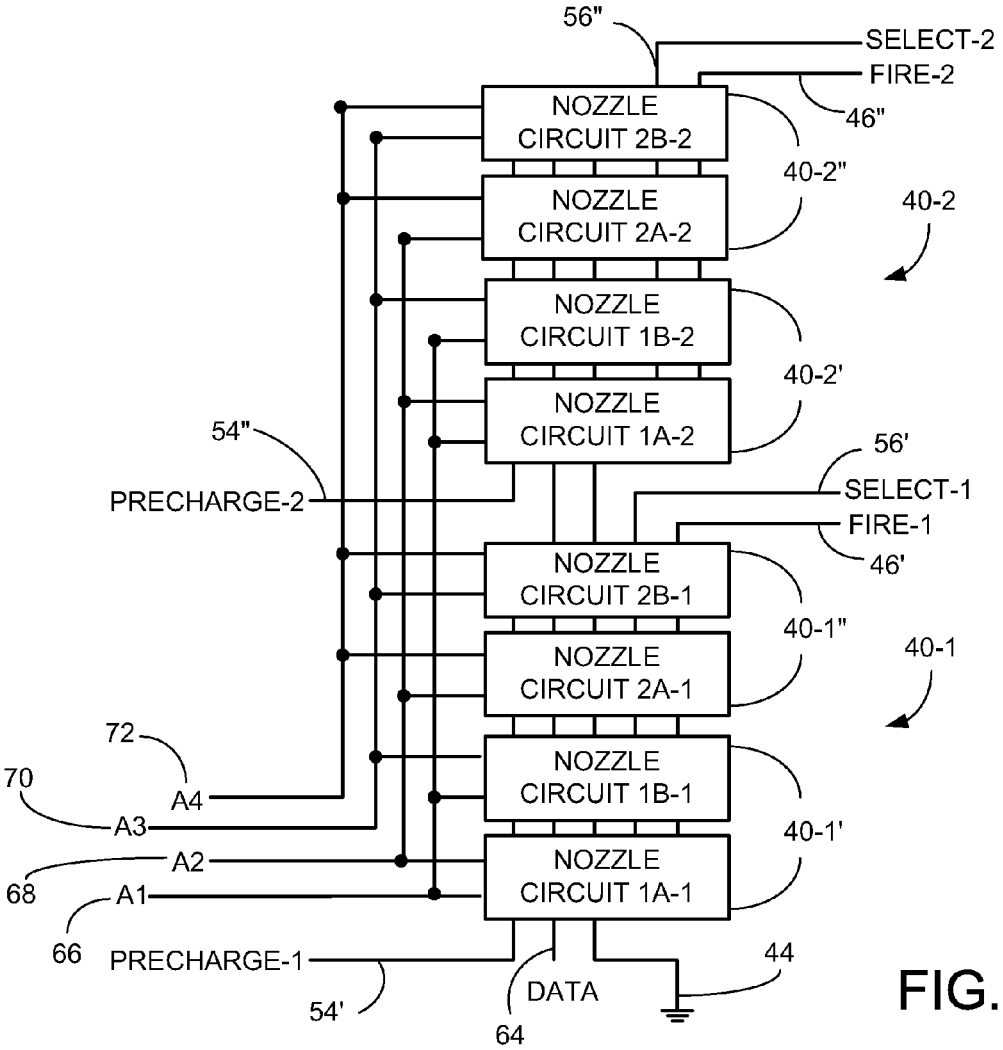

FIG. 6 is a block diagram of addressable pairs of nozzle circuits according to an embodiment.

Figure 7:
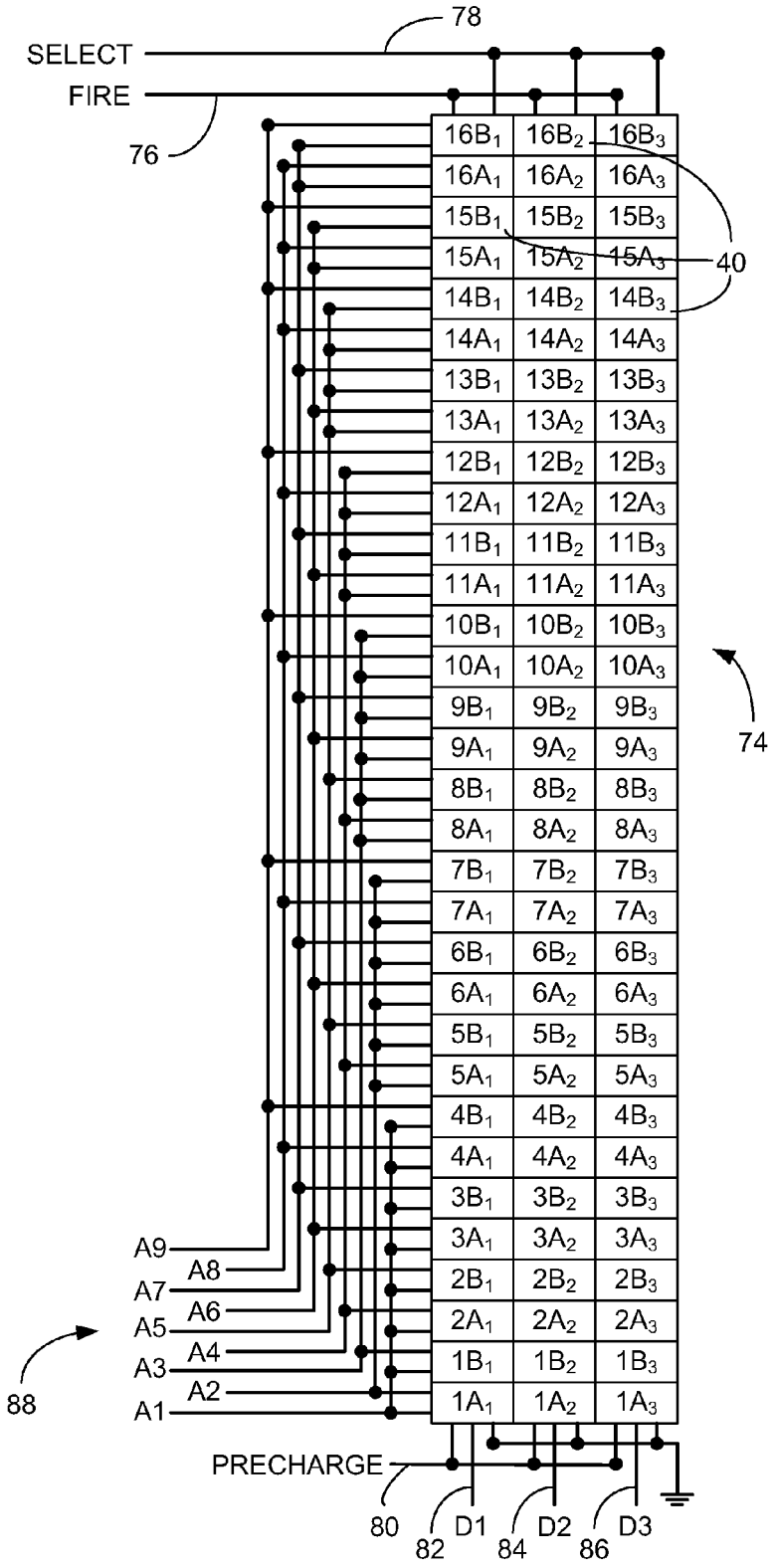

FIG. 7 is a block diagram of multiple data line groupings of addressable nozzle circuits according to an embodiment.

Figure 8:
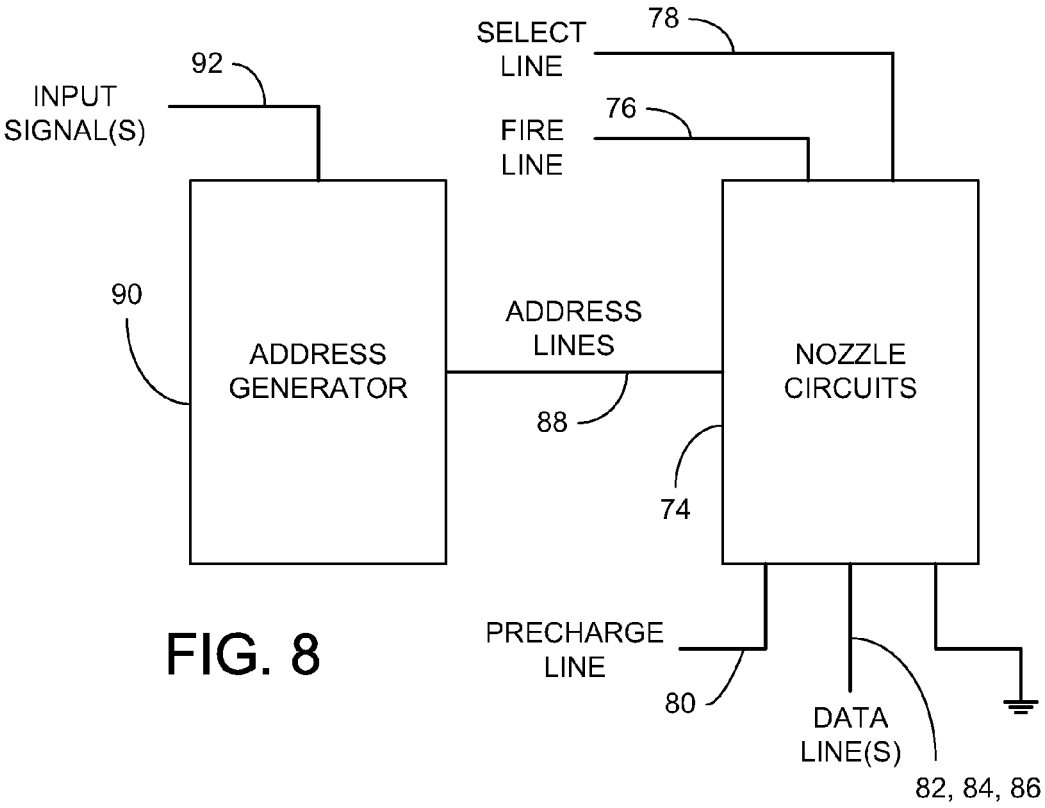

FIG. 8 is a block diagram of the nozzle circuits of FIG. 7 in communication with an address generator according to an embodiment.

Figure 9:
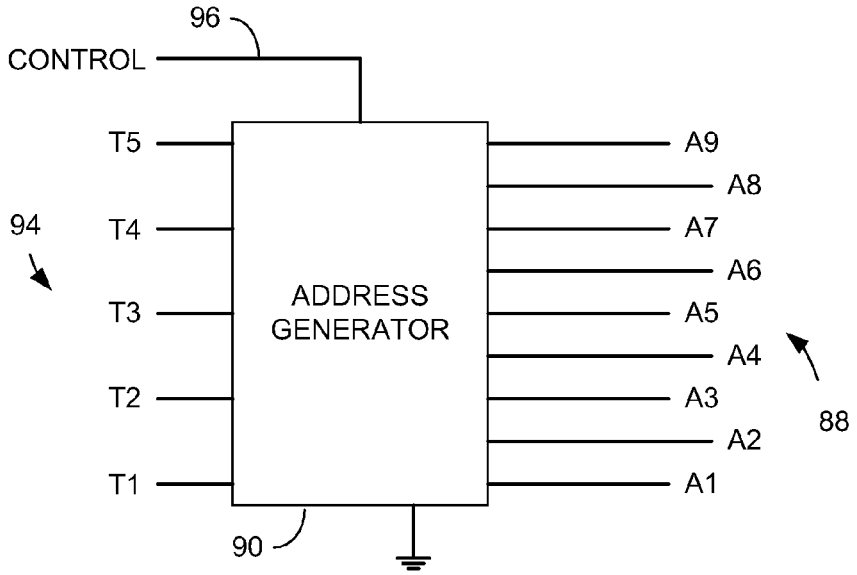

FIG. 9 is a block diagram of the address generator of FIG. 8 according to an embodiment.

Figure 10:
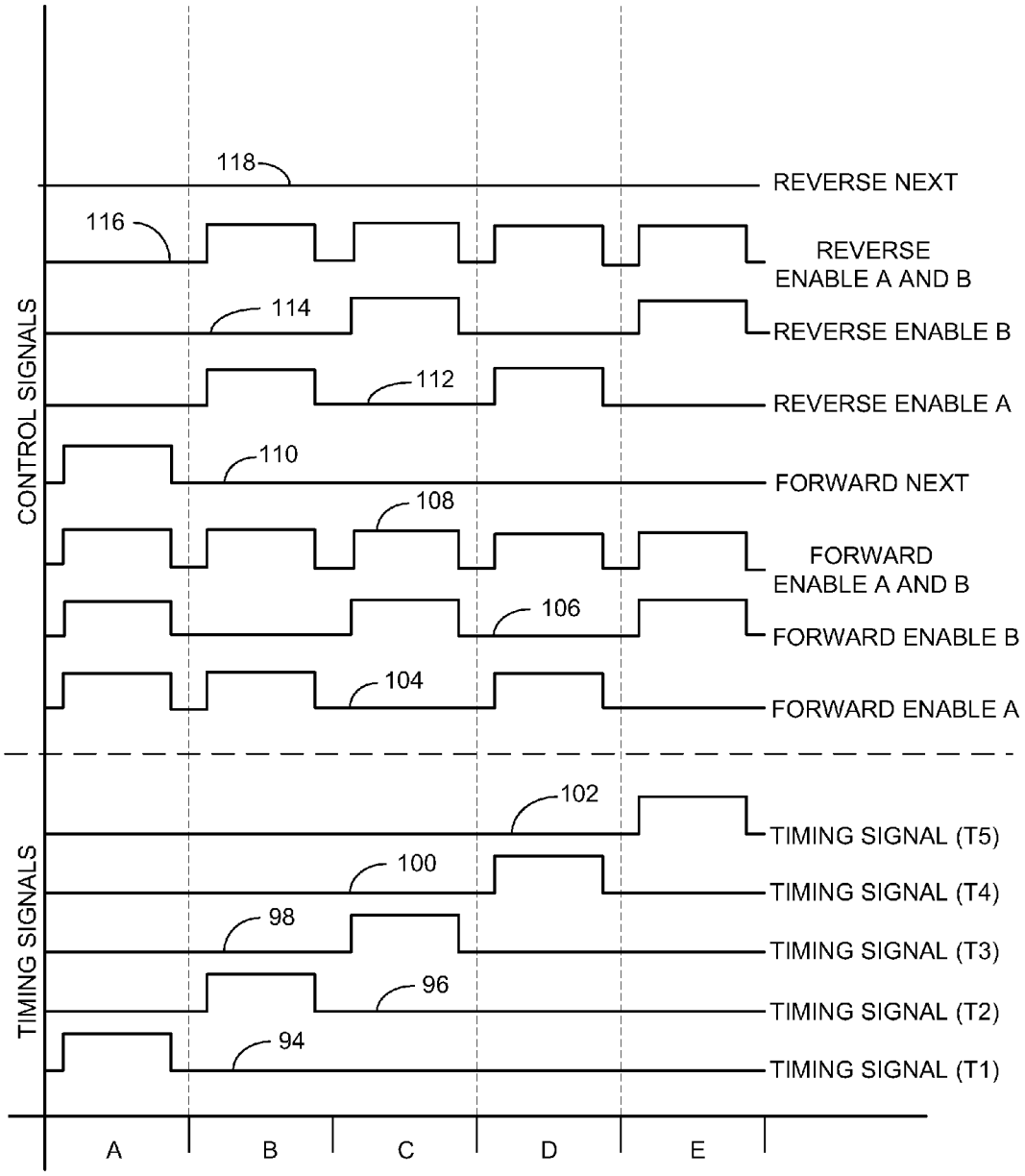

FIG. 10 is a graph illustrating exemplary control signals for instructing the address generator of FIG. 8 according to an embodiment.

Figure 11:
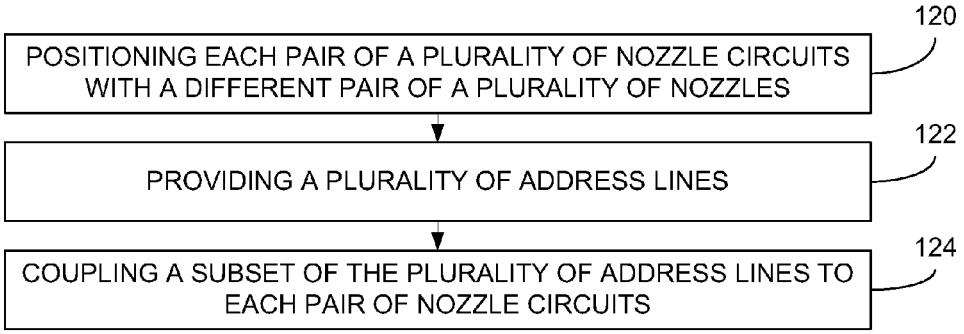
Figure 12:
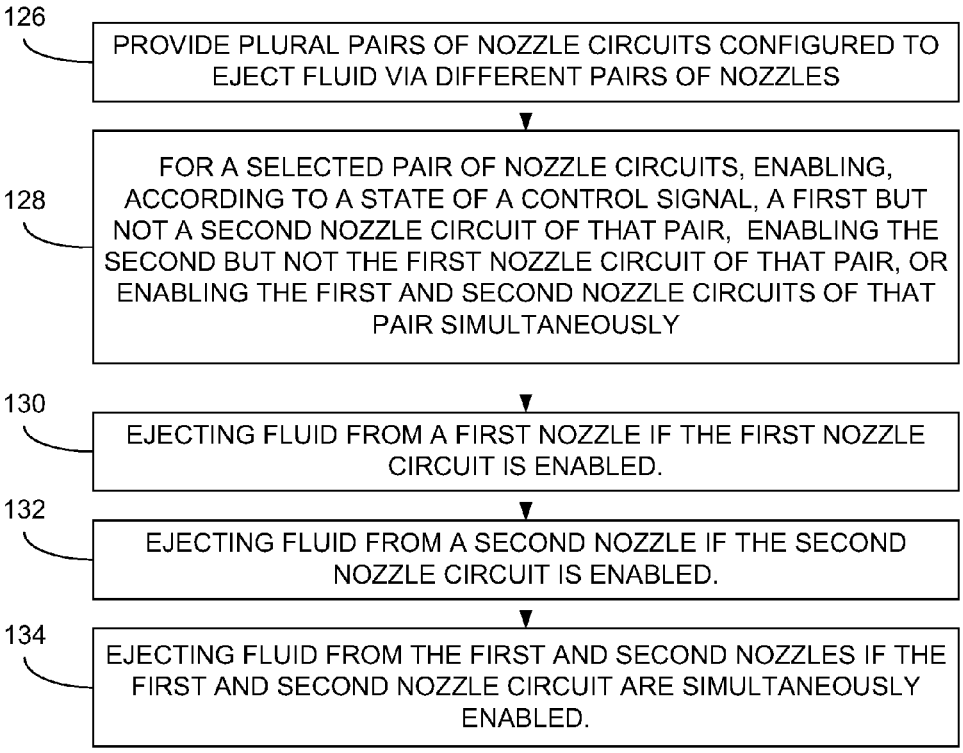

FIGS. 11 and 12 are flow diagrams illustrating exemplary steps taken to implement various embodiments of the present invention.

DETAILED DESCRIPTION

Introduction

Embodiments described below were developed in an effort to allow each of a pair of nozzle circuits in a data line grouping to be individually enabled without the other. Those two nozzle circuits can also be simultaneously enabled. Thus, where two simultaneously enabled nozzle circuits utilize adjacent nozzles, simultaneously ejected droplets merge to form a single larger droplet. Such simultaneous firing can increase fluid flux and print speeds. When a given one of those nozzle circuits is enabled and not the other, a smaller droplet is ejected. Individual firing can prove beneficial to improve print quality.

Environment

FIG. 1 is a perspective view of an exemplary fluid ejection device in the form of ink cartridge 10. Cartridge 10 includes a print head 12 located at the bottom of cartridge 10 below an internal ink holding chamber. Print head 12 includes a nozzle plate 14 with three groups 16, 18, and 20 of nozzles 22. In the embodiment shown, each group 16, 18, and 20 is a column of nozzles 22. A flexible circuit 24 carries electrical traces from external contact pads 26 to print head 12. When ink cartridge 10 is installed in a printer, cartridge 10 is electrically connected to the printer controller through contact pads 26. In operation, the printer controller selectively communicates firing and other signals to print head 12 through the traces in flexible circuit 24.

Figure 2:
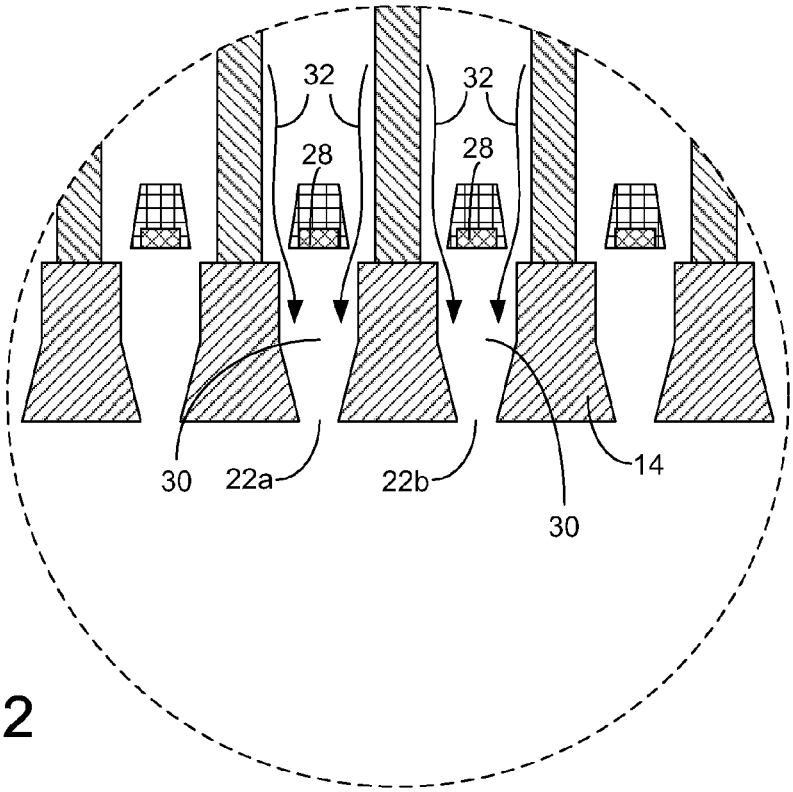
FIG. 2 is a detail section view showing a portion of the print head in the cartridge of FIG. 1.

FIG. 2 is a detail section view showing a portion of the print head 12 in the cartridge 10 of FIG. 1. Firing elements 28 are formed on an integrated circuit and positioned behind ink ejection nozzles 22*a* and 22*b*. When a firing element 28 is sufficiently energized, ink in a vaporization chamber 30 next to a firing element 28 is vaporized, ejecting a droplet of ink through a nozzle 22 on to the print media. The low pressure created by ejection of the ink droplet and cooling of chamber 30 then draws in ink to refill vaporization chamber 30 in preparation for the next ejection. The flow of ink through print head 12 is illustrated by arrows 32. Firing elements 28 represent generally any device capable of being heated by an electrical signal. For example, firing elements 28 may be resistors or other electrical components that emits heat as a result of an electrical current passing through the component.

Figure 3A:
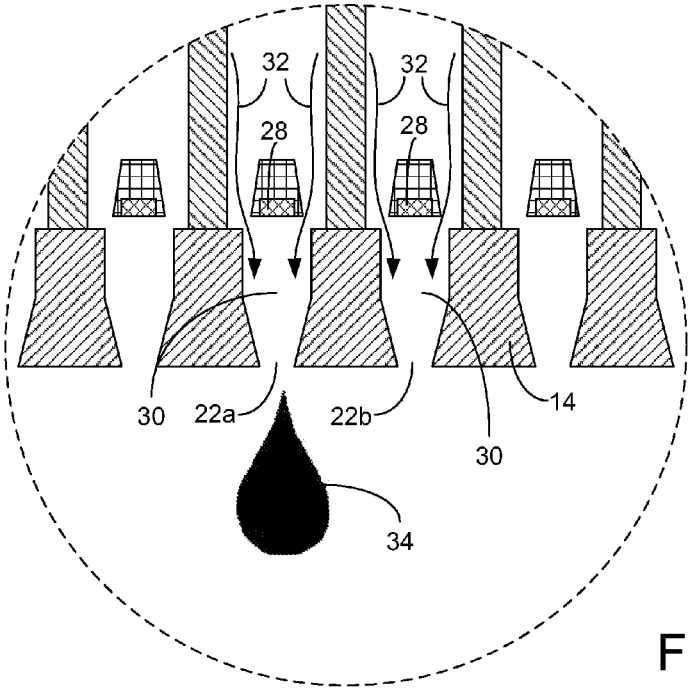
Figure 3B:
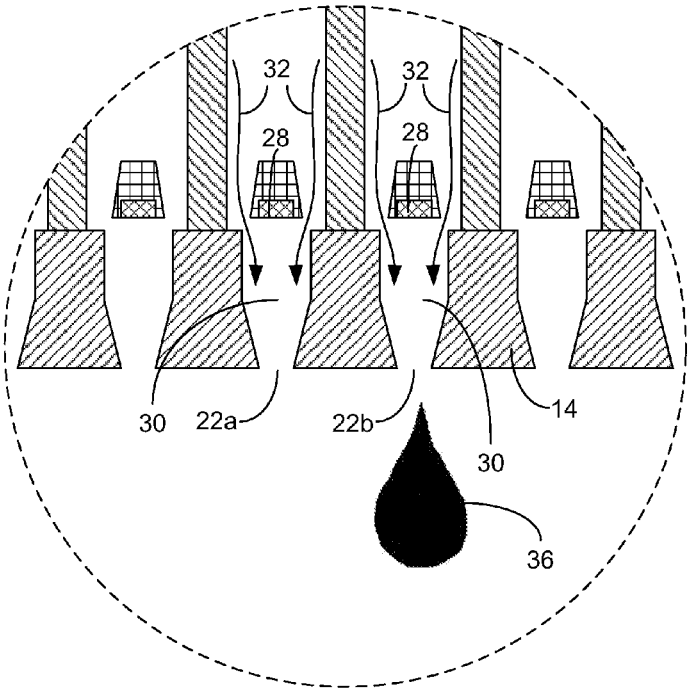
Figure 3C:
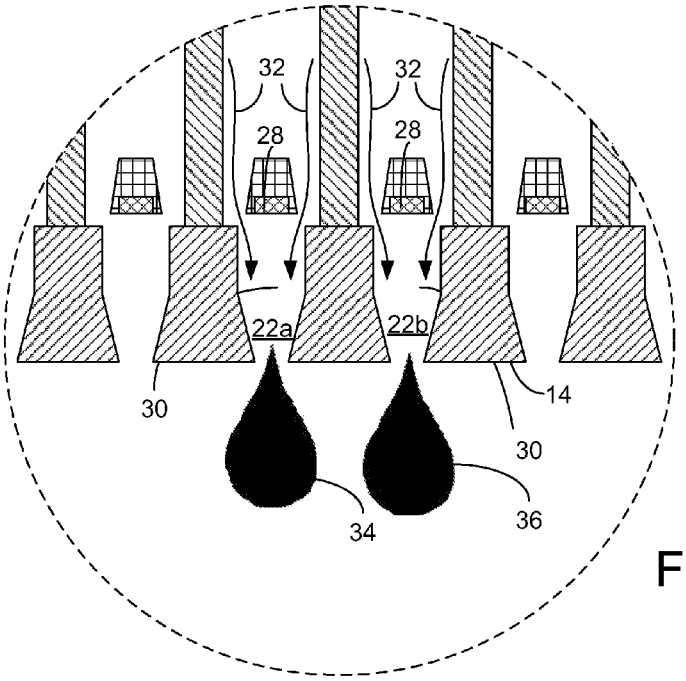
Figure 3D:
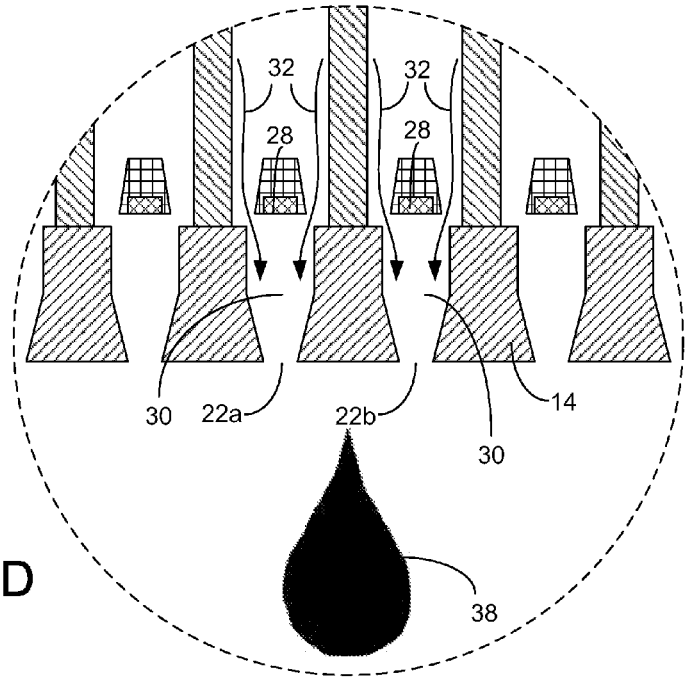

Using the detail section view of FIG. 2, FIGS. 3A-3D illustrate an example of ejecting fluid through adjacent nozzles. In FIG. 3A, a single drop 34 is ejected via nozzle 22*a*. In FIG. 3B, a single drop 36 is ejected via nozzle 22*b*. FIG. 3C shows drops 34 and 36 being ejected simultaneously via adjacent nozzles 22*a* and 22*b*. Due to the proximity of nozzles 22*a* and 22*b* to one another, drops 34 and 36 come into contact with one another and merge to form a single drop 38 as shown in FIG. 3D. Drop 38, of course, is twice the volume of drops 34 and 36. Increased print speeds can be realized when two drops are simultaneously ejected from adjacent nozzles and merge to form a larger drop as seen in FIGS. 3C and 3D. Improved print quality can be realized when, as in FIGS. 3A and 3B, drops are individually ejected.

Components

FIG. 4 is a diagram of an exemplary nozzle circuit 40. Referring also to FIG. 2, each nozzle 22 has a corresponding nozzle circuit 40 formed on an integrated circuit. In the example of FIG. 4, nozzle circuit 40 includes drive switch 42 electrically coupled to firing element 28. Drive switch 42 may be a FET including a drain-source path electrically coupled at one end to one terminal of firing element 28 and at the other end to a reference, such as ground, at 44. The other terminal of firing element 28 is electrically coupled to fire line 46 that receives an energy signal or fire signal. The energy signal includes energy pulses that energize firing element 28 if drive switch 42 is on (conducting).

The gate of drive switch 42 forms a storage node capacitance 48 that functions as a memory element to store data pursuant to the sequential activation of pre-charge transistor 50 and select transistor 52. The storage node capacitance 48 is shown in dashed lines, as it is part of drive switch 42. Alternatively, a capacitor separate from drive switch 42 could be used as a memory element.

The gate and drain-source path of pre-charge transistor 50 are electrically coupled to a pre-charge line 54 that receives a pre-charge signal. The gate of drive switch 42 is electrically coupled to the drain-source path of pre-charge transistor 50 and the drain-source path of select transistor 52. The gate of select transistor 52 is electrically coupled to a select line 56 that receives a select signal.

A data transistor 58, a first address transistor 60 and a second address transistor 62 include drain-source paths that are electrically coupled in parallel. The parallel combination of data transistor 58, first address transistor 60 and second address transistor 62 is electrically coupled between the drain-source path of select transistor 52 and reference 44. The serial circuit including select transistor 52 coupled to the parallel combination of data transistor 58, first address transistor 60 and second address transistor 62 is electrically coupled across node capacitance 48 of drive switch 42. The gate of data transistor 58 is electrically coupled to data line 64 that receives data signals. The gate of first address transistor 60 is electrically coupled to an address line 66 that receives a first address signals and the gate of second address transistor 62 is electrically coupled to a second address line 68 that receives a second address signals. The data signals and address signals are, in this example, active when low.

In operation, node capacitance 48 is pre-charged through pre-charge transistor 50 by providing a high level voltage pulse on pre-charge line 54. In one embodiment, after the high level voltage pulse on pre-charge line 54, a data signal is provided on data line 64 to set the state of data transistor 52 and address signals are provided on address lines 66 and 68 to set the states of first address transistor 60 and second address transistor 62. A high level voltage pulse is provided on select line 56 to turn on select transistor 52. In response, node capacitance 48 discharges if any one of data transistor 58, first address transistor 60 and second address transistor 62 is on. Otherwise, as long as data transistor 58, first address transistor 60 and second address transistor 62 are all off, node capacitance 48 remains charged.

Nozzle circuit 40 is "enabled" if both address signals are low. Nozzle circuit 40 is "not enabled" if one or both of the address signals are high and node capacitance 48 discharges regardless of the data signal. The first and second address transistors 60 and 62 serve as an address decoder. When nozzle circuit is enabled, data transistor 58 controls the voltage level on node capacitance 48. Thus, if nozzle circuit 40 is enabled, and data signal 64 is active (low in this example) node capacitance 48 remains charged from the pulse received on precharge line 54. As a result, a fire signal received on fire line 46 is allowed to energize firing element 28. Referring back to FIGS. 2 and 3A-3D, an energized firing element 28 vaporizes and ejects fluid via a corresponding nozzle 22.

FIG. 5 illustrates the addressing of a pair of nozzle circuits 40'. The pair 40' are identified as nozzle circuit A and nozzle circuit B. In this example, the nozzle circuit pair 40' is configured to be selectively enabled by a subset of address lines. That subset includes the triad of address lines 66, 68, and 70, and each nozzle circuit within pair 40' is configured to be enabled by a different pair of address lines 66/68 or 66/70. In other words, one address line, address line 66 in this example, is coupled to both nozzle circuits of pair 40'. Simultaneously activating address line pair 66/68 but not address line 70 individually enables nozzle circuit A so that nozzle circuit A may be used to eject a drop. Simultaneously activating address line pair 66/70 but not address line 68 individually enables nozzle circuit B, so that nozzle circuit B may be used to eject a drop. Simultaneously activating address line triad 66/68/70 simultaneously enables nozzle circuit A and nozzle circuit B so that both circuits may be used to eject drops simultaneously. Assuming the nozzles 22 for nozzle circuits A and B are arranged adjacent to one another, the simultaneously ejected drops can merge to form a single, larger drop.

The term "individually" when used in reference to one of a pair of nozzle circuits, is used to indicate an action taken with respect to one nozzle circuit and not the other at a given point in time. The term "simultaneously" when used in reference to one of a pair of nozzle circuits is used to indicate an action taken with respect to both nozzle circuits at a given point in time. The term "activating" refers to applying a signal to a given line. Depending on the circumstance, lines, such as address lines 66, 68, and 70 of FIGS. 4 and 5, can be activated by applying a low signal. Other lines such as precharge line 54, select line 56 and fire line 46 are activated by applying a high signal.

While nozzle circuit pair 40' is shown as being coupled to the triad of address lines 66, 68, and 70, that pair 40' could instead be coupled to a four address lines. Two of the four address lines would be coupled to nozzle circuit A and two others would be coupled to nozzle circuit B. Activating the first two would enable nozzle circuit A. Activating the second two would enable nozzle circuit B. Activating all four would enable nozzle circuit pair 40'.

FIG. 6 illustrates the addressing of two groups 40-1 and 40-2 of nozzle circuits. Each group 40-1 and 40-2 may be referred to as a data line grouping as both groups 40-1 and 40-2 share data line 64. However, each group 40-1 and 40-2 has its own fire line 46' and 46" respectively. Thus, while activating a pair of address lines 66-72 may enable a nozzle circuit in each group 40-1 and 40-2, only the enabled nozzle circuit that is in the group 40-1 or 40-2 that receives a fire signal will cause liquid to be ejected. Nozzle group 40-1 is shown to include nozzle circuit pairs 40-1' and 40-1" while nozzle group 40-2 is shown to include nozzle circuit pairs 40-2' and 40-2". Nozzle circuit pair 40-1' includes nozzle circuits 1A-1 and 1B-1. Nozzle circuit pair 40-1" includes nozzle circuit 2A-1 and 2B-1. Nozzle circuit pair 40-2' includes nozzle circuit 1A-2 and 1B-2, and nozzle circuit pair 40-2" includes nozzle circuit 2A-2 and 2B-2.

In the example of FIG. 6, firing circuits in groups 40-1 and 40-2 are configured to be selectively enabled using address lines 66-72. Each nozzle circuit pair 40-1', 40-1", 40-2', and 40-2" is coupled to a subset of address lines selected from address lines 66-72. In particular, each nozzle circuit pair 40-1' and 40-2" in group 40-1 is couple to a different triad 66/68/70 or 68/70/72. Nozzle circuit pair 40-1' is coupled to address line triad 66/68/70 while nozzle circuit pair 40-1" is coupled to address line triad 68/70/72. The two triads are different in that each includes at least one address line not included in the other. Furthermore, the address line not coupled to one nozzle circuit pair 40-1' and 40-1" is coupled to both nozzle circuits in the other nozzle circuit pair of nozzle circuit group 40-1. In this example, address line 66 is not coupled to nozzle circuit pair 40-1" and is coupled to both nozzle circuits of pair 40-1'. Likewise address line 72 is not coupled to nozzle circuit pair 40-1' and is coupled to both nozzle circuits in pair 40-1". Address lines 68, and 70 are coupled to both pairs 40-1' and 40-1" but are only coupled to one nozzle circuit in each pair 40-1' and 40-1". Address lines 66-72 are coupled to nozzle circuit group 40-2 in the same fashion in that a different triad of address lines 66-72 is coupled to each of nozzle circuit groups 40-2' and 40-2".

Simultaneously activating address lines 66 and 68 but not address line 70 individually enables nozzle circuits 1A-1 and 1A-2 so that nozzle circuits 1A-1 and 1A-2 may be used to eject a drop. Thus, when data line 64 is activated, a fire signal on fire line 46' causes firing circuit 1A-1 to eject fluid. Likewise, a fire signal on fire line 46" causes firing circuit 1A-2 to eject fluid. So, even when nozzle circuits in each of groups 40-1 and 40-2 are enabled simultaneously, a fire signal can be sent to only one of groups 40-1 and 40-2 so that only one of the two enabled nozzle circuits is caused to eject fluid.

Simultaneously activating address lines 66 and 70 but not address line 68 individually enables nozzle circuits 1B-1 and 1B-2. Thus, when data line 64 is activated, a fire signal on fire line 46' causes firing circuit 1B-1 to eject fluid. Likewise, a fire signal on fire line 46" causes firing circuit 1B-2 to eject fluid. So, even when nozzle circuits in each of groups 40-1 and 40-2 are enabled simultaneously, a fire signal can be sent to only one of groups 40-1 and 40-2 so that only one of the two enabled nozzle circuits is caused to eject fluid.

Simultaneously activating address line triad 66, 68, and 70 simultaneously enables nozzle circuit pairs 40-1' and 40-2'. Thus, when data line 64 is activated, a fire signal on fire line 46' causes each firing circuit in pair 40-1' to eject fluid. Likewise, a fire signal on fire line 46" causes each nozzle circuit 40-2' to eject fluid. So, even when nozzle circuit pairs 40-1' and 40-2' in each of groups 40-1 and 40-2 are enabled simultaneously, a fire signal can be sent to only one of groups 40-1 and 40-2 so that only one of the two enabled nozzle circuit pairs is caused to eject fluid.

As noted, nozzle pairs 40-1" and 40-2" are enabled by address line triad 68, 70, and 72. Simultaneously activating address lines 68 and 72 but not address line 70 individually enables nozzle circuits 2A-1 and 2A-2 so that nozzle circuits 2A-1 and 2A-2 may be used to eject a drop. Thus, when data line 64 is activated, a fire signal on fire line 46' causes firing circuit 2A-1 to eject fluid. Likewise, a fire signal on fire line 46" causes firing circuit 2A-2 to eject fluid. Simultaneously activating address lines 70 and 72 but not address line 68 individually enables nozzle circuits 2B-1 and 2B-2. Thus, when data line 64 is activated, a fire signal on fire line 46' causes firing circuit 2B-1 to eject fluid. Likewise, a fire signal on fire line 46" causes firing circuit 2B-2 to eject fluid. So, even when nozzle circuits in each of groups 40-1 and 40-2 are enabled simultaneously, a fire signal can be sent to only one of groups 40-1 and 40-2 so that only one of the two enabled nozzle circuits is caused to eject fluid.

Simultaneously activating address line triad 68, 70, and 72 simultaneously enables nozzle circuit pairs 40-1" and 40-2". Thus, when data line 64 is activated, a fire signal on fire line 46' causes each firing circuit in pair 40-1" to eject fluid. Likewise, a fire signal on fire line 46" causes each nozzle circuit 40-2" to eject fluid. So, even when nozzle circuit pairs 40-1" and 40-2" in each of groups 40-1 and 40-2 are enabled simultaneously, a fire signal can be sent to only one of groups 40-1 and 40-2 so that only one of the two enabled nozzle circuit pairs is caused to eject fluid.

In the example of FIG. 6, each nozzle circuit within a given nozzle group 40-1 and 40-2 can be enabled individually by activating a particular pair of address lines 66-72. Furthermore both nozzle circuits in a given nozzle pair 40-1', 40-2, 40-2' or 40-2" can be enabled by activating a particular triad of address lines 66-72. However, within each group 40-1 and 40-2, a different triad of address lines 66-72 is responsible for enabling each nozzle circuit pair. In other words, within a particular nozzle group, each nozzle circuit pair is couple to a unique triad of address lines. The triads are unique in that with respect to any two pairs of nozzle circuits within the group, the triad for enabling one of those pairs includes one address line 66, 68, 70, or 72, that is not included in the triad.

In one implementation it is important to ensure that the activation of any given triad of address lines coupled to one or more pairs of nozzle circuits activates only those nozzle circuits in that pair or pairs and no others. Thus, the triads connected to each pair of nozzle circuits are unique in that activating any one triad will enable only the nozzle circuit pair or pairs to which that triad is coupled. As already noted, two address lines are coupled to each nozzle circuit. For each nozzle pair 40-1', 40-1", 40-2', and 40-2" one address line of a given triad is coupled to both nozzle circuits of that pair leaving a pair of address lines from that triad that are each coupled to only one of the nozzle circuits of that pair. The pair of address lines from the triad that are each coupled to only one nozzle circuit of a pair or pairs of nozzle circuits, are not coupled together to any single nozzle circuit. In the example of FIG. 6, address line triad 66/68/70 is coupled to nozzle circuit pair 40-1'. From that triad, address line pair 68/70 are each coupled to only one nozzle circuit of pair 40-1'. Furthermore, address line pair 68/70 are not coupled together to any single nozzle circuit. If they were, activating address line triad 68/70/72 to enable nozzle circuit pair 40-1' would also enable that hypothetical nozzle circuit. It is noted that address line 68 and 70 may each be coupled to other nozzle circuits. Address line 70, however, is not coupled to any nozzle circuit that address line 68 is couple to.

While FIG. 6 illustrates a triad of address lines coupled to each nozzle circuit pair, each pair could instead be coupled to four address lines. However, such an implementation would use two additional address lines (not shown). For example, nozzle circuits 1A-1 and 1A-2 could be coupled to address lines 66 and 68. Nozzle circuits 1B-1 an 1B-2 could be coupled to address lines 70 and 72. Nozzle circuits 2A-1 and 2A-2 could be coupled to address lines 66 and one of the additional address lines. Nozzle circuits 2B-1 and 2B-2 could be coupled to address line 68 and the other of the additional address lines.

FIG. 7 illustrates a group 74 of nozzle circuits 40 coupled to fire line 76, select line 78, and precharge line 80. Nozzle circuit group 74 is segregated into three data line groupings corresponding to data lines 82, 84, and 86 respectively. Each data line grouping is shown, in this example, to include sixteen pairs nozzle circuits 40. Each pair of nozzle circuits 40 in a given data line grouping is enabled by a unique triad of address lines 88. Furthermore, each nozzle circuit 40 within a data line grouping is enabled by a different pair of address lines 88.

While group 74 is shown to include three data line groupings, group 74 could include any number of data line groupings. Additional data line groupings would result in additional data lines. Fewer would result in fewer data lines. While each data line grouping in nozzle circuit group 74 is shown to include sixteen pairs or thirty-two nozzle circuits 40 selectively enabled by nine address lines 88, each data line grouping may include more or fewer nozzle circuits 40. Increasing the number of nozzle circuits may result in the use of additional address lines 88 while reducing the number of nozzle circuits, as can be seen in FIG. 6, may result in the use of fewer address lines 88. A given fluid ejection device may include multiple groups 74 each coupled to its own fire and select lines.

To cause a particular pair of nozzle circuits 40 to eject fluid, $7A_2$ and $7B_2$ for example, the following steps are taken. Precharge line 80 is activated followed by the activation of data line 84 and the triad of address lines 88 labeled A2/A8/A9. Select line 78 is activated and a fire signal is communicated via fire line 76. Activation of the triad of address lines A2/A8/A9, simultaneously enables the three nozzle circuit pairs labeled $7A_1/7B_1$, $7A_2/7B_2$, and $7A_3/7B_3$. However, because only data line 84 is activated, the fire signal only causes the pair of nozzle circuits 40 labeled $7A_2/7B_2$ to eject fluid. If data line 82 were also activated, then the fire signal would also cause the pair of nozzle circuits 40 labeled as $7A_1/7B_1$ to eject fluid. The same can be said for data line 86 and the pair of nozzle circuits 40 labeled as $7A_3/7B_3$. Furthermore, activating address line pair labeled as A2/A8 (and not A9) individually enables nozzle circuits $7A_{1-3}$. Activating address line pair labeled as A2/A9 (and not A8) individually enables nozzle circuits $7B_{1-3}$.

Thus, address lines 88 are coupled to each data line grouping such that a different pair of the address lines 88 are used to enable each nozzle circuit 40 in that grouping. While any one address line 88 can be coupled to multiple nozzle circuits 40, any given pair of address lines 88 is coupled to no more than one nozzle circuit 40 in a data line grouping. In one implementation it is important to ensure that the activation of any given triad of address lines 88 coupled to one or more pairs of nozzle circuits 40 activates only those nozzle circuits 40 in that pair or pairs and no other nozzle circuits 40. Thus, the triad connected to each pair of nozzle circuits are unique in that activating any one triad will enable only the nozzle circuit pair or pairs to which that triad is coupled. As already noted, two address lines are coupled to each nozzle circuit 40. For each nozzle pair, one address line 88 of a given triad is coupled to both nozzle circuits 40 of that pair leaving a pair of address lines from that triad that are each coupled to only one of the nozzle circuits 40 of that pair. The pair of address lines from the triad that are each coupled to only one nozzle circuit 40 of a pair or pairs of nozzle circuits are not coupled together to any one nozzle circuit 40. In the example of FIG. 7, address line triad A1/A2/A3 is coupled to nozzle circuit pairs $1A_1/1B_1$, $1A_2/1B_2$, and $1A_3/1B_3$. From that triad A1/A2/A3, address line pair A2/A3 are each coupled to only one nozzle circuit 40 or each of pairs $1A_1/1B_1$, $1A_2/1B_2$. Furthermore, address line pair A2/A3 are not coupled together to any one nozzle circuit 40. If they were, activating address line triad A1/A2/A3 to enable nozzle circuit pairs $1A_1/1B_1$, $1A_2/1B_2$, and $1A_3/1B_3$ would also enable that hypothetical nozzle circuit. The same analysis holds true for address line pairs A4/A5, A6/A7, and A8/A9.

While FIG. 7 illustrates a triad of address lines coupled to each nozzle circuit pair, each pair could instead be coupled to a subset of four address lines. In such an implementation additional address lines would be required so that the two address lines coupled to any one nozzle circuit in a given data line grouping of group 74 are not coupled together to any other nozzle circuit of that data line grouping of group 74. Further, the address lines would also have to be configured so that activating the four address lines coupled to one nozzle circuit pair enables only that nozzle circuit pair.

FIG. 8 is a block diagram illustrating address generator 90 coupled to the nozzle circuit group 74 of FIG. 7. Address generator 90 represents circuitry configured to activate, at a given point in time, a particular pair or triad of address lines 88. Address generator 90 selects the particular pair or triad of address lines 88 according to signals supplied via input line(s) 92. In the example of FIG. 9, input lines 92 include five timing lines 94 and control line 96. Timing lines 94 are labeled as T1-T5.

Each timing line 94 is configured to receive and communicate a timing signal to address generator 90. The timing signals communicated via timing lines 94 provide address generator 90 with a repeating series of five pulses with each timing signal providing one pulse in the series of five pulses. In one example, a pulse communicated via timing line 94 labeled as T1 is followed by a pulse communicated via timing line 94 labeled as T2, which is followed by a pulse communicated via timing line 94 labeled as T3, which is followed by a pulse in communicated via timing line 94 labeled as T4, which is followed by a pulse communicated via timing line 94 labeled as T5. After the pulse communicated via timing line 94 labeled as T5, the series repeats beginning with a pulse being communicated via timing line 94 labeled as T1. Control line 96 is used to communicate control pulses coincident with pulses communicated via timing lines 94.

Address generator 90 activates a selected address line pair or triad in response to the control signal received via control line 96. The particular action taken by address generator 90 depends upon whether or not one or more pulses in the control signal coincide with one or more timing pulses. FIG. 10 provides an example illustrating a graph depicting a series of five timing signals 94-102 each including a pulse at a different point in time than the other timing signals. Thus, timing signals 94-102 provide a series of five pulses. FIG. 10 also depicts eight different control signals 104-118 that may be supplied to address generator 90. Each control signal includes zero to five pulses each timed to coincide with a pulse of a particular timing signal 92-102.

In the example of FIG. 10, signals 94-118 span time periods A-E. Timing signal 94 includes a pulse in time period A. Timing signal 96 includes a pulse in time period B. Timing signal 98 includes a pulse in time period C. Timing signal 100 includes a pulse in time period D, and timing signal 102 includes a pulse in time period E.

When ejecting ink to form a desired image on a sheet of paper or other media, a fluid ejecting device such as an ink cartridge may be moved back and forth along on a first axis across the media while the media is moved along a second axis orthogonal to the first. In one example, control signals 104-110 that include a pulse in time period A coinciding with the pulse in timing signal 94 are utilized when the fluid ejecting device is moved in one direction along the first axis. Control signals 112-118 that do not include a pulse during time period A are used when the fluid ejecting device is moved in the opposite direction along the that first axis.

Control signal 104 includes pulses in periods A, B, and D that coincide with the pulses of timing signals 94, 96, and 100. The pulse in period A indicates the forward direction. The pulses in time slots B and D cause address generator to "point" to and enable one of a next pair of nozzle circuits. The term "point" is used to indicate that the address generator 90 is placed in a state to enable one nozzle circuits in that pair. For ease in explanation, one nozzle circuit in any given pair can be referred to as nozzle circuit A, while the other can be referred to as nozzle circuit B. Thus, control signal 104 causes address generator 90 to activate the address lines coupled to nozzle circuit A of that next pair.

Control signal 106 includes a pulse in time periods A, C and E. As with control signal 104, the pulse in period A indicates the forward direction. The pulses in time periods C and E coincide with the pulses of timing signals 98 and 102 respectively. The pulses in time slots C and E cause address generator 90 to point to and enable nozzle circuit B of the next pair of nozzle circuits. To do so, address generator 90 activates the address lines coupled to that particular nozzle circuit. Control signal 108 includes pulses in time periods A-E. Again, the pulse in period A indicates the forward direction. The pulses in time periods B-E coincide with the pulses of timing signals 96-102 respectively and cause address generator 90 to point to and enable nozzle circuits A and B of the next pair of nozzle circuits by activating the triad of address lines coupled to the pair.

When address generator 90 is first initialized, it does not point to a nozzle circuit or circuits. In such a case, control signal 104 causes address generator 90 to point to and enable nozzle circuit A of first pair of a group of nozzle circuits. In the example of FIG. 7, that nozzle circuit would be nozzle circuit 40 labeled 1A in each data line grouping. A subsequent control signal 110 would cause address generator 90 to point to and enable nozzle circuit A of the next pair. In the example of FIG. 7, that nozzle circuit would be nozzle circuits 40 labeled 2A in each data line grouping. Thus, in the Example of FIG. 7, starting with control signal 104 followed by repeating control signal 110 fifteen times, sequentially enables nozzle circuit A of each of the sixteen pairs of nozzle circuits in each data line grouping.

Starting with control signal 106 causes address generator to point to and enable nozzle circuit B of the first pair of nozzle circuits. In the example of FIG. 7, that nozzle circuit would be nozzle circuits 40 labeled 1B in each data line grouping. A subsequent control signal 110 would cause address generator 90 to point to and enable nozzle circuit B of the next pair. In the example of FIG. 7, that nozzle circuit would be nozzle circuits 40 labeled 2B in each data line grouping. Thus, in the Example of FIG. 7, starting with control signal 106 followed by repeating control signal 110 fifteen times, sequentially enables nozzle circuit B of each of the sixteen pairs of nozzle circuits in each data line grouping.

Starting with control signal 108 causes address generator to point to and enable nozzle circuits A and B of the first pair of nozzle circuits. In the example of FIG. 7, those nozzle circuits would be nozzle circuits 40 labeled 1A and 1B in each data line grouping. A subsequent control signal 110 would cause address generator 90 to point to and enable nozzle circuits A and B of the next pair. In the example of FIG. 7, those nozzle circuits would be nozzle circuits 40 labeled 2A and 2B in each data line grouping. Thus, in the Example of FIG. 7, starting with control signal 108 followed by repeating control signal 110 fifteen times, sequentially enables nozzle circuits A and B of each of the sixteen pairs of nozzle circuits in each data line grouping.

Control signal 112 includes pulses in periods B and D that coincide with the pulses of timing signals 96 and 100. The lack of a pulse in period A indicates the reverse direction. The pulses in time slots B and D cause address generator to point to and enable nozzle circuit A of a next pair of nozzle circuits. To do so, address generator 90 activates the address lines coupled to that particular nozzle circuit. Control signal 114 includes a pulse in time periods C and E. As with control signal 112, the lack of a pulse in period A indicates the reverse direction. The pulses in time periods C and E coincide with the pulses of timing signals 98 and 102 respectively. The pulses in time slots C and E cause address generator 90 to point to and enable nozzle circuit B of the next pair of nozzle circuits. To do so, address generator 90 activates the address lines coupled to that particular nozzle circuit. Control signal 116 includes pulses in time periods B-E. Again, the lack of a pulse in period A indicates the reverse direction. The pulses in time periods B-E coincide with the pulses of timing signals 96-102 respectively and cause address generator 90 to point to and enable nozzle circuits A and B of the next pair of nozzle circuits by activating the triad of address lines couple to the pair.

When address generator 90 is first initialized, it does not point to a nozzle circuit or circuits. In such a case, control signal 112 causes address generator 90 to point to and enable nozzle circuit A of first pair of a group of nozzle circuits in a reverse order. In the example of FIG. 7, that nozzle circuit would be nozzle circuits 40 labeled 16A in each data line grouping. A subsequent control signal 118 would cause address generator 90 to point to and enable nozzle circuit A of the next pair in reverse order. In the example of FIG. 7, that nozzle circuit would be nozzle circuits 40 labeled 15A in each data line grouping. Thus, in the Example of FIG. 7, starting with control signal 112 followed by repeating control signal 118 fifteen times, sequentially enables, in reverse order, nozzle circuit A of each of the sixteen pairs of nozzle circuits in each data line grouping.

Starting with control signal 114 causes address generator to point to and enable nozzle circuit B of the first pair of nozzle circuits in reverse order. In the example of FIG. 7, that nozzle circuit would be nozzle circuits 40 labeled 16B in each data line grouping. A subsequent control signal 118 would cause address generator 90 to point to and enable nozzle circuit B of the next pair in reverse order. In the example of FIG. 7, that nozzle circuit would be nozzle circuits 40 labeled 15B in each data line grouping. Thus, in the Example of FIG. 7, starting with control signal 114 followed by repeating control signal 118 fifteen times, sequentially enables, in reverse order, nozzle circuit B of each of the sixteen pairs of nozzle circuits in each data line grouping.

Starting with control signal 116 causes address generator to point to and enable nozzle circuits A and B of the first pair of nozzle circuits in reverse order. In the example of FIG. 7, those nozzle circuits would be nozzle circuits 40 labeled 16A and 16B in each data line grouping. A subsequent control signal 118 would cause address generator 90 to point to and enable nozzle circuits A and B of the next pair in reverse order. In the example of FIG. 7, those nozzle circuits would be nozzle circuits 40 labeled 15A and 15B in each data line grouping. Thus, in the Example of FIG. 7, starting with control signal 116 followed by repeating control signal 118 fifteen times, sequentially enables, in reverse order, nozzle circuits A and B of each of the sixteen pairs of nozzle circuits in each data line grouping.

Thus, by selectively supplying control signals 104-118, address generator can be caused to individually and simultaneously enable nozzle circuits in selected nozzle circuit pairs.

Operation

FIGS. 11 and 12 are exemplary flow diagrams illustrating steps taken to implement various method implementations. FIG. 11 illustrates steps taken construct a fluid ejecting device while FIG. 12 illustrates steps taken to utilize that fluid ejecting device. Starting with FIG. 11, each pair of a plurality of nozzle circuits is positioned with a different pair of a plurality of nozzles (step 120). FIGS. 1, 2 and 6 provide an example. Referring back to FIGS. 1 and 2, a fluid ejection device 10 having a plurality of nozzles 22 is shown. FIG. 2 shows each of a pair of firing elements 28 position with a pair of nozzles 22*a* and 22*b*. FIG. 4 illustrates that each firing element 28 of FIG. 2 is part of a nozzle circuit 40. FIG. 7 shows that a fluid ejection device can include plural pairs of nozzle circuits 40.

Continuing with FIG. 11, a plurality of address lines are provided (step 122). A different subset of the plurality of address lines provided in step 122 is coupled to each pair of nozzle circuits (step 124). Step 124 is performed so that for each given subset of address lines coupled to one or more of the pairs of nozzle circuits, simultaneous activation of the address lines of that subset simultaneously enables each nozzle circuit in the pair or pairs of nozzle circuits coupled to that subset and none of the other nozzle circuits of the plurality of nozzle circuits. As explained above, a given subset may be a triad of the plurality of address lines or it may include a group of four of the plurality of address lines. FIGS. 5, 6, and 7 show different examples of providing and coupling address lines that are consistent with steps 122 and 124.

As seen in FIGS. 5-7, a fire line capable of communicating a fire signal may be coupled to the plurality of nozzle circuits.

Further, each pair of nozzles positioned with a pair of nozzle circuits may be arranged such that when the nozzle circuits of that nozzle circuit pair are simultaneously enabled, fluid ejected via that pair of nozzles in response to the fire signal merges to form a single drop of a volume greater than would be generated if fluid were ejected from only one of the nozzle circuits.

In one example, each subset of address lines coupled to a pair of nozzle circuits in step 124 may be a triad that includes a first pair and a second pair of address lines. One of those address lines is shared between the two pairs of address lines. In such a fashion, the first pair of address lines but not the second pair of address lines individually enables the first nozzle circuit of a given pair. Activating the second pair of address lines but not the first pair of address lines individually enables the second nozzle circuit of that pair. Activating the first and second pairs of address lines simultaneously enables the first and second nozzle circuits of that pair. In another example, that subset may include a group of four of the plurality of address lines such that the two pairs are unique. In other words, one pair enables the first nozzle circuit and a second enables the second nozzle circuit. Activating both pairs enables both nozzle circuits. Examples of such can be seen in FIGS. 5, 6, and 7.

In another example, a data line may be coupled to the plurality of nozzle circuits such as the data lines shown in FIGS. 5 and 6. In this example, a different triad of the plurality of address lines is coupled to each pair of nozzle circuits. In this manner, simultaneous activation of every address line of a given subset simultaneously enables each nozzle circuit in a corresponding pair of nozzle circuits coupled to that subset and none of the other nozzle circuits. Examples of such can be seen in FIGS. 5 and 6.

Further elaborating on the method illustrated in FIG. 11, step 124 can include coupling a triad of the plurality of address lines to a first pair of the nozzle circuits. The first triad is coupled such that a first address line selected from the first triad is coupled to each nozzle circuit of the first nozzle circuit pair. A second address line selected from the first triad is coupled to a first but not a second nozzle circuit of the first nozzle circuit pair. A third address line selected from the first triad is coupled to the second but not the first nozzle circuit of the first nozzle circuit pair. FIG. 5 provides an example.

Step 124 of FIG. 11 can also include coupling first and second subsets of the plurality of address lines to first and second pairs of the plurality of nozzle circuits. The first and second subsets include four address lines of the plurality of address lines. In one implementation, the first and second subsets are coupled such that a first of the four address lines is coupled to each nozzle circuit of the first nozzle circuit pair. A second of four address lines is coupled to a first but not a second nozzle circuit of the first nozzle circuit pair and to a first but not a second nozzle circuit of the second nozzle circuit pair. A third of the four address lines is coupled to the second but not the first nozzle circuit of the first nozzle circuit pair and to the second but not the first nozzle circuit of the second nozzle circuit pair. A fourth of the four address lines is coupled to each nozzle circuit of the second nozzle circuit pair. FIGS. 6 and 7 provide various examples.

The method illustrated in FIG. 11 can also include coupling an address generator to the plurality of address lines. The address generator is configured to selectively activate each subset of the plurality of address lines that is coupled to one of the pairs of the plurality of nozzle circuits according to a control signal. An example of such an address generator is shown and described with reference to FIGS. 8-10.

FIG. 12 illustrates exemplary steps taken to utilize a fluid ejection device. Plural pairs of circuit pairs are provided (step 126). Each provided pair is configured to eject fluid via a different pair of nozzles. FIGS. 1, 2 and 6 provide an example. Referring back to FIGS. 1 and 2, a fluid ejection device 10 having a plurality of nozzles 22 is shown. FIG. 2 shows each of a pair of firing elements 28 position with a pair of nozzles 22*a* and 22*b*. FIG. 4 illustrates that each firing element 28 of FIG. 2 is part of a nozzle circuit 40. FIG. 7 shows that a fluid ejection device can include plural pairs of nozzle circuits 40.

Continuing with FIG. 12, for a selected pair of the plural pair of nozzle circuits, one, the other, or both of the nozzle circuits of that selected pair are selectively enabled according to a states of a received control signal or signals (step 128). Based on the states of the control signal or signals, a first but not the second nozzle circuit of that pair may be enabled, the second but not the first nozzle circuit of that pair many enabled, or both the first and second nozzle circuits of that pair may be enabled. FIGS. 4, 7, 8, 9, and 10 illustrate examples of plural pairs of nozzle circuits and corresponding control signals for selectively enabling those pairs of nozzle circuits that are consistent with step 128.

Fluid is ejected from a first nozzle to form a drop of a first volume in response to a fire signal if the first nozzle circuit is enabled (step 130). Fluid is ejected from the second nozzle to form a drop of the first volume in response to the fire signal if the second nozzle circuit is enabled (step 132). Fluid is ejected from the first and second nozzles simultaneously to form a drop of a second volume greater than the first volume in response to the fire signal if the first and second nozzle circuits are enabled (step 134). Examples of steps 130-134 are illustrated with respect to FIGS. 3A-3D.

Elaborating on the method illustrated in FIG. 12, the selected pair of nozzle circuits may be a first selected pair of the plurality of nozzle circuits. The method may also include selectively enabling, according to the states of received control signals, one, the other, or both nozzle circuits of a second selected pair of the plural pairs of nozzle circuits. The method then would also include ejecting, in response to a fire signal, fluid from a third of the plurality nozzles to form a drop of a first volume if the first nozzle circuit of the second selected pair is enabled. Fluid would be ejected from a fourth nozzle of the plurality of nozzles to form a drop of the first volume if the second nozzle circuit of the second selected pair is enabled. Fluid from the third and fourth nozzles would be simultaneously ejected to form drop of a second volume greater than the first volume if the first and second nozzle circuits of the second selected pair are simultaneously enabled.

In another example, each of the plural pairs of nozzle circuits is coupled to a triad of address lines selected from a plurality of address lines. In such a case selectively enabling the selected pair of nozzle circuits in step 128 includes activating a first and a second but not a third address line of the triad of address lines coupled to the selected pair of nozzle circuits to individually enable the first nozzle circuit. To individually enable the second circuit, the first and the third but not the second address line of the triad of address lines coupled to the selected pair of nozzle circuits are activated. The first, the second, and the third address lines of the triad of address lines coupled to the selected pair of nozzle circuits are activated to simultaneously enable the first and second nozzle circuits.

Elaborating further on the method illustrated in FIG. 12, the control signal of step 128 may be one of a series of control signals including a first control signal having a first state and a subsequent second control signal having a second state. The fire signal of steps 130-132 may be one of a series of fire signals including a first fire signal associated with the first control signal and a subsequent second fire signal associated with the second control signal. In this example, selectively enabling in step 128 includes enabling the first nozzle circuit of the selected pair but not the second nozzle circuit of the selected pair in response to the first control signal and subsequently simultaneously enabling the first and second nozzle circuits of the selected pair in response to the second control signal. Steps 130-134 would then involve ejecting fluid from the first nozzle in response to the first fire signal and subsequently ejecting fluid from the first and second nozzles simultaneously in response to the second fire signal. Furthermore, the first and second control signals may be received via a control line such that first control signal includes a first series of pulses and the second control signal includes a second series of pulses different than the first series of pulses.

Conclusion

The environments FIGS. 1-2 and 3A-3D are exemplary environments in which embodiments of the present invention may be implemented. Implementation, however, is not limited to these environments. The diagrams of FIGS. 4-10 show the architecture, functionality, and operation of various embodiments. Although the flow diagrams of FIGS. 11-12 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

The present invention has been shown and described with reference to the foregoing exemplary embodiments. It is to be understood, however, that other forms, details and embodiments may be made without departing from the spirit and scope of the invention that is defined in the following claims.

What is claimed is:

1. A printer cartridge, comprising:

a plurality of address lines, including a first subset of address lines and a second subset of address lines, the first and second subsets combined including four address lines;

a fire line for communicating a fire signal; and a plurality of nozzle circuits, including a first pair of nozzle circuits and a second pair of nozzle circuits, coupled to the fire line and the plurality of address lines, each nozzle circuit configured, when enabled, to eject fluid via a different one of a plurality of nozzles in response to the fire signal, wherein a subset of the plurality of address lines is coupled to each pair of the plurality of nozzle circuits so that, for each given subset of address lines coupled to one or more of the pairs of the plurality of nozzle circuits simultaneous activation of every address line of that subset simultaneously enables each nozzle circuit in the pair or pairs of nozzle circuits coupled to a given triad and none of the other nozzle circuits of the plurality of nozzle circuits, wherein a first address line of the four address lines is coupled to each nozzle circuit of the first nozzle circuit pair;

wherein a second address line of the four address lines is coupled to a first but not a second nozzle circuit of the first nozzle circuit pair and to a first but not a second nozzle circuit of the second nozzle circuit pair;

wherein a third address line of the four address lines is coupled to the second but not the first nozzle circuit of the first nozzle circuit pair and to the second but not the first nozzle circuit of the second nozzle circuit pair; and wherein a fourth address line of the four address lines is coupled to each nozzle circuit of the second nozzle circuit pair.

2. The printer cartridge of claim 1, wherein for each pair of nozzle circuits coupled to given subset of address lines:

a first nozzle circuit of that pair is coupled to a first pair of address lines from the given subset of address lines and the a second nozzle circuit of that pair is coupled to a second pair of address lines from the given subset that is different than the first pair, the first and second pairs of address lines sharing one address line from the given triad of address lines;

activating the first pair of address lines but not the second pair of address lines individually enables the first nozzle circuit;

activating the second pair of address lines but not the first pair of address lines individually enables the second nozzle circuit; and activating the first and second pairs of address lines simultaneously enables the first and second nozzle circuits.

3. The printer cartridge of claim 1, further comprising a data line coupled to the plurality of nozzle circuits, and wherein a different triad of the plurality of address lines is coupled to each pair of the plurality of nozzle circuits so that for each given subset of address lines coupled to one of the pairs of the plurality of nozzle circuits, simultaneous activation of every address line of that subset simultaneously enables the each circuit in that one pair of nozzle circuits coupled to the given triad and no other nozzle circuit of the plurality of nozzle circuits.

4. The printer cartridge of claim 1, wherein each subset of the plurality of address lines coupled one of the pairs of the plurality of nozzle circuits includes a first pair of address lines and a second pair of address lines, the first and second pairs of address lines sharing one of the plurality of address lines, the device further comprising an address generator configured to, for each triad of the plurality of address lines, including the given triad, coupled to one of the pairs of the plurality of nozzle circuits, to selectively:

activate the first pair of address lines but not the second pair;

activate the second pair of address lines but not the pair; and activate the first and second pairs of address lines simultaneously.

5. The printer cartridge of claim 1, wherein each of the plurality of nozzles is positioned with respect to one another such that:

when a first and a second nozzle circuit of any given pair of the plurality of nozzle circuits are simultaneously enabled, fluid ejected via two of the plurality of nozzles in response to the fire signal merge to form a single drop of a first volume, when either the first or the second nozzle circuit of any given pair of the plurality of nozzle circuits is individually enabled, fluid ejected via one of the plurality of nozzles in response to the fire signal forms a drop of a second volume that is less than the first volume, and when either the first or the second nozzle circuit of any given pair of the plurality of nozzle circuits is individually enabled, the fluid ejected via the one of the plurality of nozzles in response to the fire signal is ejected substantially parallel to the one of the plurality of nozzles.

6. A printer cartridge, comprising:

a pair of nozzle circuits including a corresponding pair of nozzles;

a plurality of address lines, a subset of the plurality of address lines are coupled to the pair of nozzle circuits so that for each given subset of address lines coupled to the pair of nozzle circuits, simultaneous activation of every address line of that subset simultaneously enables each nozzle circuit in the pair of nozzle circuits coupled to a given triad and no other nozzle circuits of the printer cartridge; and a fire line coupled to the pair of nozzle circuits, wherein the fire line is to communicate a fire signal to the pair of nozzle circuits, wherein a subset of the plurality of address lines are coupled to nozzle circuits such that first and second triads of the plurality of address lines are coupled to first and second pairs of the plurality of nozzle circuits, the first and second triads including four address lines of the plurality of address lines, wherein a first of the four address lines is coupled to each nozzle circuit of the first nozzle circuit pair, wherein a second of four address lines is coupled to a first but not a second nozzle circuit of the first nozzle circuit pair and to a first but not a second nozzle circuit of the second nozzle circuit pair, wherein a third of the four address lines is coupled to the second but not the first nozzle circuit of the first nozzle circuit pair and to the second but not the first nozzle circuit of the second nozzle circuit pair, and wherein a fourth of the four address lines is coupled to each nozzle circuit of the second nozzle circuit pair.

7. The printer cartridge of claim 6, wherein the plurality of address lines is coupled to the pair of nozzle circuits such that the given triad of the plurality of address lines is coupled to pair of nozzle circuits so that, for the pair of nozzle circuits coupled to the given triad of address lines:

a first nozzle circuit of that pair of nozzle circuits is coupled to a first pair of address lines from the given triad of address lines and the second nozzle circuit of that pair of nozzle circuits is coupled to a second pair of address lines from the given triad that is different than the first pair of address lines, the first and second pairs of address lines sharing one of the given triad of address lines;

activating the first pair of address lines but not the second pair of address lines individually enables the first nozzle circuit;

activating the second pair of address lines but not the first pair of address lines individually enables the second nozzle circuit; and activating the first and second pairs of address lines simultaneously enables the first and second nozzle circuit.

8. The printer cartridge of claim 7, wherein the nozzles of the pair of nozzles are positioned such that when one of the nozzle circuits is individually enabled, fluid ejected via one of the arranged pair of nozzles in response to the fire signal forms a single drop of a second volume that is less than the first volume.

9. The printer cartridge of claim 6, further comprising:

a data line coupled to the nozzle circuits, wherein a subset of the plurality of address lines are coupled to the pair of nozzle circuits such that a different triad of the plurality of address lines are coupled to the pair of nozzle circuits so that for each triad of address lines, including the given triad, coupled to the pair of nozzle circuits, simultaneous activation of every address line of that triad simultaneously enables each nozzle circuit in the pair of nozzle circuits coupled to that triad and no other nozzle circuit of the print cartridge.

10. The printer cartridge of claim 6, wherein the pair of nozzles are positioned such that when the nozzle circuits of that nozzle circuit pair are simultaneously enabled, fluid ejected via that pair of nozzles in response to the fire signal merges to form a single drop of a first volume, and wherein the pair of nozzles are positioned such that when either the first or the second nozzle circuit of the corresponding pair of nozzle circuits is individually enabled, the fluid ejected via the one of the plurality of nozzles in response to the fire signal is ejected substantially parallel to the one of the plurality of nozzles.

11. A printer cartridge, comprising:

a plurality of address lines, including a first subset of address lines and a second subset of address lines, the first and second subsets combined including four address lines;

a plurality of nozzle circuits, including a first pair of nozzle circuits and a second pair of nozzle circuits, coupled to the fire line and the plurality of address lines, each nozzle circuit configured, when enabled, to eject fluid via a different one of a plurality of nozzles in response to the fire signal, the first pair of nozzle circuits including:

a first nozzle circuit including a first nozzle to eject a first droplet of printer ink when the first nozzle circuit is enabled; and a second nozzle circuit including a second nozzle to eject a second droplet of printer ink when the second nozzle circuit is enabled, the ejection axis of the second droplet being parallel to the ejection axis of the first droplet, wherein the first and second nozzles are positioned with respect to one another such that the first droplet ejected from the first nozzle and the second droplet ejected from the second nozzle merge to form a merged droplet before contacting a print media, wherein a subset of the plurality of address lines is coupled to each pair of the plurality of nozzle circuits so that, for each given subset of address lines coupled to one or more of the pairs of the plurality of nozzle circuits simultaneous activation of eve address line of that subset simultaneously enables each nozzle circuit in the pair or pairs of nozzle circuits coupled to a given triad and none of the other nozzle circuits of the plurality of nozzle circuits, wherein a first address line of the four address lines is coupled to each nozzle circuit of the first nozzle circuit pair;

wherein a second address line of the four address lines is coupled to a first but not a second nozzle circuit of the first nozzle circuit pair and to a first but not a second nozzle circuit of the second nozzle circuit pair;

wherein a third address line of the four address lines is coupled to the second but not the first nozzle circuit of the first nozzle circuit pair and to the second but not the first nozzle circuit of the second nozzle circuit pair; and wherein a fourth address line of the four address lines is coupled to each nozzle circuit of the second nozzle circuit pair.

12. The printer cartridge of claim 11, wherein the first nozzle circuit and the second nozzle circuit are to form a merged droplet that is about double the size of the first droplet.

13. The printer cartridge of claim 11, wherein the first nozzle circuit and the second nozzle circuit are to eject respective droplets to form a merged droplet when the first and second nozzle circuits simultaneously eject their respective droplets.

14. The printer cartridge of claim 11, wherein the first nozzle and the second nozzle are adjacent nozzles of the printer cartridge.

15. The printer cartridge of claim 11, wherein the printer cartridge allows for: (1) a first mode in which the first nozzle and the second nozzle are not instructed to simultaneously eject droplets, and (2) a second mode in which the first nozzle and the second nozzle are instructed to simultaneously eject droplets.

16. The printer cartridge of claim 15, wherein the first mode corresponds to a high print quality setting and the second mode corresponds to a fast print speed setting.

17. The printer cartridge of claim 15, wherein in the first mode, a firing element of the first nozzle circuit is activated so as to eject a droplet from the first nozzle and a firing element of the second nozzle circuit is not activated, and wherein in the second mode, the firing element of the first nozzle circuit and the firing element of the second nozzle circuit are both activated so as to eject respective droplets from respective first and second nozzles.

* * * * *